US009854339B2

(12) United States Patent
Nagatani et al.

(10) Patent No.: US 9,854,339 B2
(45) Date of Patent: Dec. 26, 2017

(54) SPEAKER SYSTEM

(71) Applicants: Pioneer Corporation, Tokyo (JP); Tohoku Pioneer Corporation, Yamagata (JP); Technical Audio Devices Laboratories, Inc., Tokyo (JP)

(72) Inventors: Toru Nagatani, Yamagata (JP); Tomohiro Suenaga, Yamagata (JP); Haruki Takeda, Yamagata (JP); Kiichirou Ohtomo, Yamagata (JP)

(73) Assignees: PIONEER CORPORATION, Tokyo (JP); TOHOKU PIONEER CORPORATION, Yamagata (JP); TECHNICAL AUDIO DEVICES LABORATORIES, INC., Tokyo (JP)

( * ) Notice: Subject to any disclaimer, the term of this patent is extended or adjusted under 35 U.S.C. 154(b) by 0 days.

(21) Appl. No.: 15/129,082

(22) PCT Filed: Mar. 28, 2014

(86) PCT No.: PCT/JP2014/059362

§ 371 (c)(1),
(2) Date: Sep. 26, 2016

(87) PCT Pub. No.: WO2015/145774

PCT Pub. Date: Oct. 1, 2015

(65) Prior Publication Data

US 2017/0127164 A1 May 4, 2017

(51) Int. Cl.

| | |
|---|---|
| ***H04R 1/28*** | (2006.01) |
| ***H04R 1/02*** | (2006.01) |
| ***H04R 1/34*** | (2006.01) |

(52) U.S. Cl.

CPC ..... *H04R 1/025* (2013.01); *H04R 1/2826* (2013.01); *H04R 1/345* (2013.01)

(58) Field of Classification Search

CPC ..... H04R 1/28; H04R 1/2869; H04R 1/2873; H04R 1/2876; H04R 1/42; H04R 9/022

(Continued)

(56) References Cited

U.S. PATENT DOCUMENTS 6,324,292 B1 * 11/2001 Mitsuhashi ..... H04R 1/288 181/151

6,654,472 B1 11/2003 Jeon (Continued)

FOREIGN PATENT DOCUMENTS

JP 04-126488 11/1992
JP 06-038284 2/1994

(Continued)

OTHER PUBLICATIONS

International Search Report, PCT/JP2014/059362, dated Jun. 24, 2014.

*Primary Examiner* — Suhan Ni
(74) *Attorney, Agent, or Firm* — Young & Thompson

(57) ABSTRACT

A speaker system including a speaker device and a cabinet. The cabinet is composed of; a front wall having a substantially rectangular parallelepiped shape and is provided with a speaker device affixed thereto; a rear wall opposing to the front wall; and two pairs of side walls arranged between the front wall and the rear wall. A first duct communicating with the interior space of the cabinet is provided through the side wall of the cabinet. A first opening that makes the interior space of the cabinet communicated with a first opening is provided at an area that encompasses a center portion of the one side wall in the one pair of the side walls having the shorter mutual distance therebetween in the two pairs of the side walls.

11 Claims, 8 Drawing Sheets

(58) Field of Classification Search
USPC ..... 381/351–354, 162, 397
See application file for complete search history.

(56) References Cited

U.S. PATENT DOCUMENTS

| | | | | |
|---|---|---|---|---|
| 6,912,390 | B2 * | 6/2005 | Andersson | H04W 36/12 370/331 |
| 7,181,039 | B2 * | 2/2007 | Stiles | H04R 1/02 381/354 |
| 8,170,255 | B2 * | 5/2012 | Visscher | E04B 1/8209 381/345 |
| 2004/0131219 | A1 * | 7/2004 | Polk, Jr. | H04R 1/2826 381/345 |

FOREIGN PATENT DOCUMENTS

| | | |
|---|---|---|
| JP | 06-062484 | 3/1994 |
| JP | 2000-295682 | 10/2000 |

* cited by examiner

SPEAKER SYSTEM

TECHNICAL FIELD

The present invention relates to a speaker system.

BACKGROUND ART

The speaker cabinet described in PTL 1 for example, has been known as the above-mentioned the speaker system. This speaker cabinet includes a first cabinet to which a speaker unit is affixed, and a second cabinet for forming a bass-reflex duct which is affixed to a bottom plane of the first cabinet. At the end portion of the first cabinet-bottom wall, there is provided an opening communicating with the bass-reflex duct.

The first cabinet is formed in a substantially rectangular parallelepiped shape, and includes three pairs of wall portions that are mutually opposing. Between these mutually opposing wall portions, there are respectively generated standing waves in each of which a wall portion serves as a node, and a central portion serves as an arc-shaped portion. Although the amplitude of typical standing wave takes the minimum value at the nodes of vibration, its sound pressure takes the maximum value at the same. As aforementioned, providing an opening at the end portion of the first cabinet-bottom wall is to provide the opening at a portion corresponding to a node of the standing wave, that is, the portion at which the sound pressure of the standing wave is maximized. Accordingly, there has been a concern that the influence of the standing wave with respect to sounds radiated through the bass-reflex duct becomes a serious matter, for an example. In particular, the provision of the opening in the bottom wall of the first cabinet elongated in a vertical direction shall lead to an occurrence of large peaks or dips at the low frequency range of the sound.

SUMMARY OF INVENTION

Technical Problem

In view of the above, the present invention aims, for example, to provide a speaker system that is less susceptible to the influence of the standing wave.

Solution to Problem

In order to address the above mentioned concern, an one aspect of the present invention provides a speaker system comprising: a speaker device; and a cabinet including a speaker-fixation wall to which the speaker device is to be affixed, an opposing wall opposing to the speaker-fixation wall, and two pairs of side walls opposing to each other that are provided between the speaker-fixation wall and the opposing wall, wherein a first duct communicating with an interior space of the cabinet is provided at the side wall of the cabinet, and wherein a first opening that makes the interior space of the cabinet communicated with an inlet of the first duct is provided at an area encompassing a central portion of one side wall in an one pair of side walls that has a shorter mutual distance therebetween in the two pairs of side walls.

DESCRIPTION OF EMBODIMENTS

Figure 1:
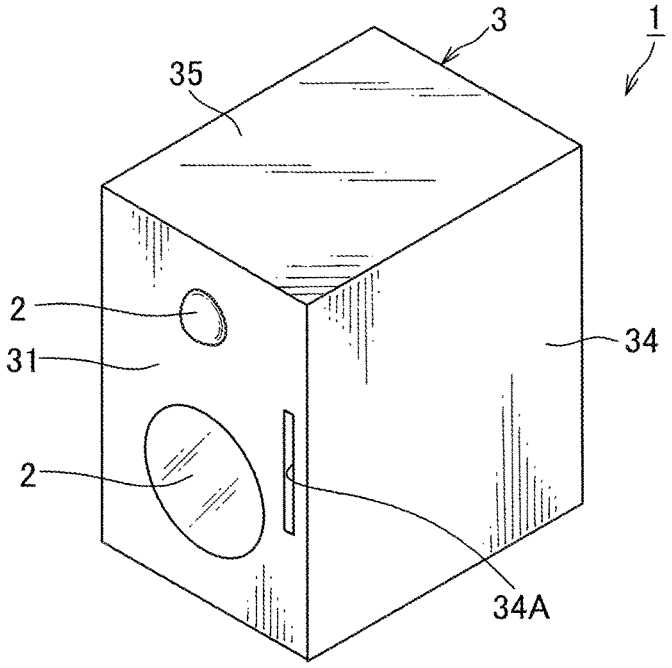
FIG. 1 is a perspective view of the speaker system in the first example of the present invention.
Figure 2:
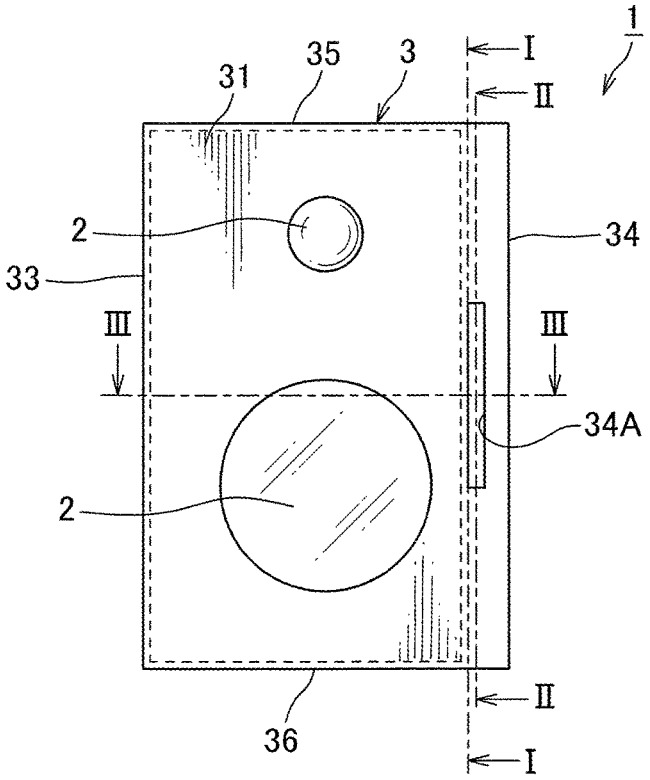
FIG. 2 is a front view of the speaker system shown in FIG. 1.

Hereinafter, the speaker system in accordance with an one embodiment of the present invention is described. The speaker system in accordance with one embodiment of the present invention is composed of a speaker device, and a cabinet including a speaker-fixation wall to which the speaker device is to be affixed, an opposing wall that opposes to the speaker-fixation wall, and mutually opposing two pairs of side walls provided between the speaker-fixation wall and the opposing wall. The side wall of the cabinet is provided with a first duct that communicates with the interior space of the cabinet. A first opening that makes the interior space of the cabinet communicated with the inlet of the first duct is also provided at an area that encompasses a central portion of one side wall in the one pair of side walls having a shorter mutual distance therebetween in the two pairs of side walls.

Due to such a configuration, the first opening is allowed to be provided at a portion corresponding to an arc-shaped portion of the standing wave having low frequency being prone to exert influence on the frequency characteristic of a speaker, that is, the portion at which the sound pressure of standing wave is minimized, whereby the speaker system becomes to be less susceptible to the influence of the standing wave.

Further, the first duct may be extended along the side wall through which the first opening is provided, and the outlet of the first duct may be provided at a further forward position in the sound-wave-radiation direction than the inlet thereof. Thereby, the sound that has passed through the first duct is allowed to be radiated forwardly in the sound-wave-radiation direction.

Alternatively, the first duct may be made extended along the side wall through which the first opening is provided, and the outlet of the first duct may be provided at a further backward position in the sound-wave-radiation direction than the inlet thereof. Thereby, the sound that has passed through the first duct is allowed to be radiated backwardly in the sound-wave-radiation direction.

Further, at the side wall of the cabinet, a second duct that communicates with the interior space of the cabinet is provided, and a second opening that makes the interior space of the cabinet communicated with the inlet of the second duct may be provided at an area that encompasses a central portion of the other side wall in the one pair of side walls having a shorter mutual distance therebetween in the two pairs of side walls. Due to such a configuration, the second opening can be provided at a portion corresponding to an arc-shaped portion of the standing wave having low frequency being prone to exert influence on the frequency characteristic of a speaker, that is, the portion at which the sound pressure of standing wave is minimized, whereby the speaker system becomes to be less susceptible to the influence of the standing wave.

Alternatively, at least one of the first duct and the second duct communicating with its inlet may be made extended along the side wall, through which the first opening or the second opening is provided, and the outlet of at least one of the first duct and the second duct may be provided at a further forward position in the sound-wave-radiation direction than the inlet thereof. Thereby, the sound having passed through the first duct or the second duct is allowed to be radiated forwardly in the sound-wave-radiation direction.

Alternatively, at least one of the first duct and the second duct communicating with its inlet may be made extended along the side wall through which the first opening or the second opening is provided, and the outlet of at least one of the first duct and the second duct may be provided at a further backward position in the sound-wave-radiation direction than the inlet thereof. Thereby, the sound that has passed through the first duct is allowed to be radiated backwardly in the sound-wave-radiation direction.

Further, the first duct may be provided such that its square measures become larger towards the outlet from the inlet. Thereby, the sound wave can be radiated without causing unnecessary turbulent air or the like within the first duct.

Further, the first duct may be provided such that its widthwise sizes become larger in a direction parallel to the side wall through which the first opening is provided, and such that its widthwise sizes maintain a constant value in a direction intersecting with the side wall through which the first opening is provided. Thereby, the square measures of the first duct are allowed to be larger while its widthwise sizes intersecting with the side wall through which the first opening is provided, are maintained in constant.

Further, at least one of the first duct and the second duct may be provided such that square measures thereof become larger towards the outlet from the inlet. Thereby, the sound wave is allowed to be radiated without causing unnecessary turbulent air or the like within the first duct or the second duct.

Further, at least one of the first duct and the second duct may be provided such that its widthwise sizes become larger towards the outlet from the inlet in a direction parallel to the side wall through which the first opening or the second opening is provided, and such that its widthwise sizes in a direction intersecting with the side wall through which the first opening or the second opening is provided, maintain a constant value. Thereby, the square measures of the second duct may be made lager towards the outlet from the inlet while its widthwise sizes intersecting with the side wall through which the second opening is provided, are kept in constant.

Further, in the first opening, the peripheral portion opposing in a direction extending from the inlet to the outlet may be provided so as to be positioned in closer proximity to each other as approaching to the central portion. Thereby, the sound wave is allowed to be radiated without causing unnecessary turbulent air or the like within the first duct.

Alternatively, in either one of the first opening or the second opening, the peripheral portion opposing in a direction extending from the inlet to the outlet of the first duct or the second duct may be provided so as to be positioned in closer proximity to each other as approaching to the central portion. Thereby, the sound wave can be radiated without causing unnecessary turbulent air or the like within the first duct or the second duct.

First Example

Next, the speaker system 1 in the first example is described with reference to FIG. 1 to FIG. 6. As shown in the figures, the speaker system 1 is composed of a speaker device 2, and a cabinet 3 having a rectangular parallelepiped shape, to which the speaker device 2 is affixed. In this example, two pieces of speaker device 2 are affixed to the cabinet 3. The above-described cabinet 3 is composed of a front wall 31 as a speaker-fixation wall to which the speaker device 2 is affixed, a rear wall 32 as an opposing wall opposing to the front wall 31, and two pairs of side walls 33 and 34, and side walls 35 and 36, arranged between the front wall 31 and the rear wall 32.

In the front wall 31, the above-mentioned two speaker devices 2 are mounted side by side on an inner surface thereof. The front wall 31 is formed in a rectangular shape elongated in a direction in which the two speaker devices 2 are arranged. The rear wall 32 is formed in a rectangular shape elongated in a direction in which the two speaker devices 2 are arranged in a similar manner as the front wall 31. Hereinafter, to simplify the description, it will be made such that the above-mentioned arrangement direction is the vertical direction, the opposing direction in which the front wall 31 and the rear wall 32 opposes to each other is the front to rear direction, a direction intersecting with both the arrangement direction and the front to rear direction is the crosswise direction.

Each of the side walls 33 to 36 is provided so as to stand towards peripheral portion of the rear wall 32 from the peripheral portion of the front wall 31. Side walls 33 and 34 are respectively provided so as to stand from the peripheral portion of the front wall 31 extending in the vertical direction of the front wall 31, and oppose to each other in the crosswise direction. These side walls 33 and 34 are formed in substantially the same shape having an equivalent square measure. The side walls 35 and 36 are provided so as to stand from the peripheral portion extending in the crosswise direction of the front wall 31 and oppose to each other in the vertical direction. These side walls 35 and 36 are also formed in substantially the same shape having an equivalent square measure.

As aforementioned, since the front wall 31 and the rear wall 32 are provided in an elongated manner in the vertical direction, the distance between the side walls 33 and 34 is designed so as to be shorter than the distance between the side walls 35 and 36. That is, the side walls 33 and 34 correspond to the one pair of side walls having shorter mutual distance therebetween in the two pairs of the side walls 33 and 34, and the side walls 35 and 36.

Figure 5:
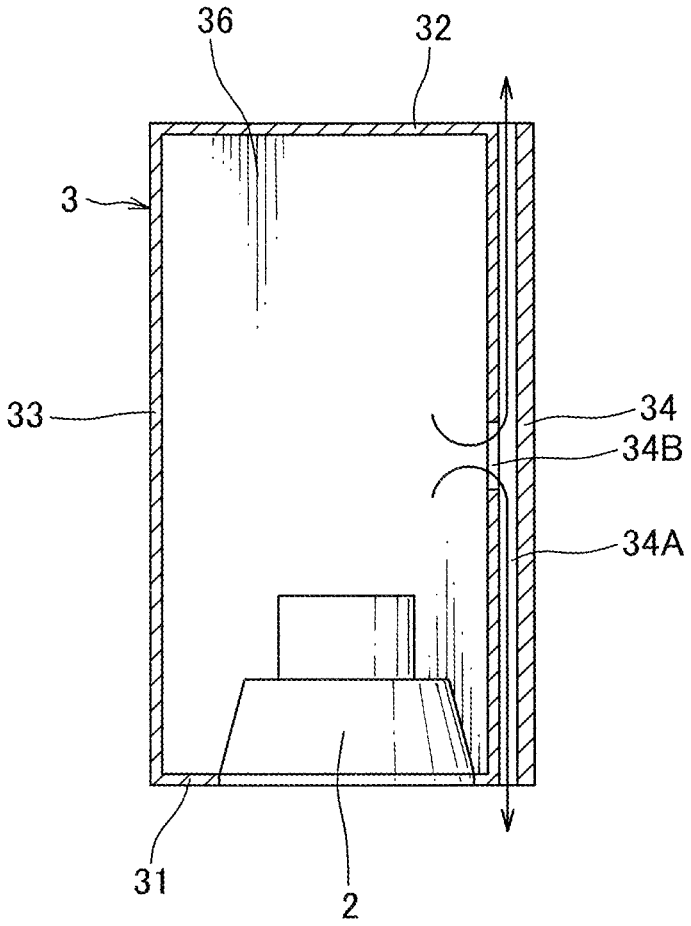
FIG. 5 is a cross section taken at the line III-III in FIG. 3.

In the side wall 34 that is the one side wall of the one pair of the side walls 33 and 34, as shown in FIG. 5, a first duct 34A communicating with the interior space of the cabinet 3 which constitutes a space surrounded by the walls 31 to 36. The first duct 34A is designed so as to pass the low tones generated in the rearward side in the front to rear direction of the speaker device 2 therethrough to radiate towards the outside of the cabinet 3.

The first duct 34A is extended in the front to rear direction along the side wall 34, and its outlet is provided at both the further forward side (i.e., the sound-wave-radiation direction side) and the further rearward side (i.e., the reverse side, reverse to sound-wave-radiation direction). That is, the front wall 31 and the rear wall 32 are respectively provided with an opening, that serves as the outlet of the first duct 34A. The above-described cross section in the first duct 34A is formed in the rectangular shape elongated in the vertical direction, and is provided so as to maintain a substantially constant square measure towards the outlet from the inlet.

Figure 3:
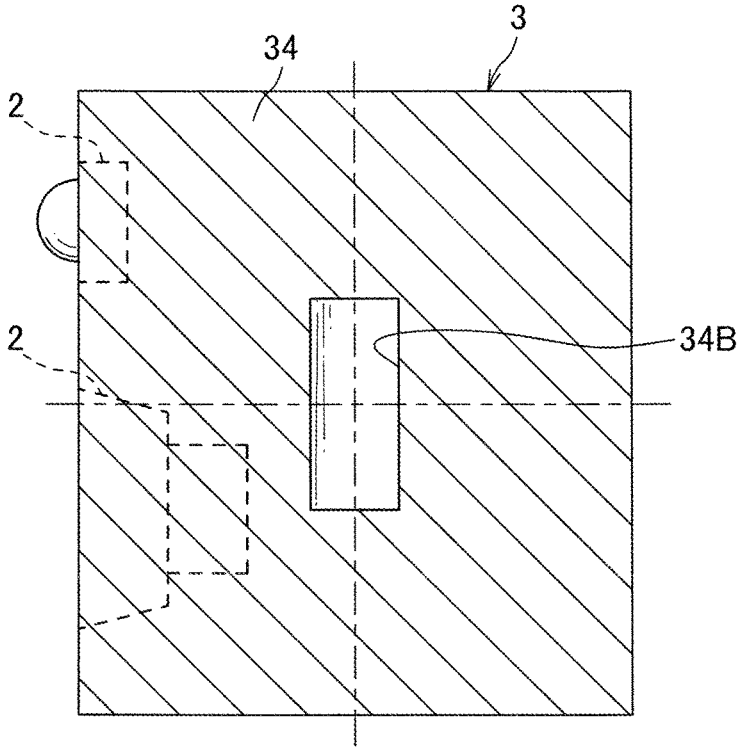
FIG. 3 is a cross section taken at the line I-I in FIG. 2.
Figure 4:
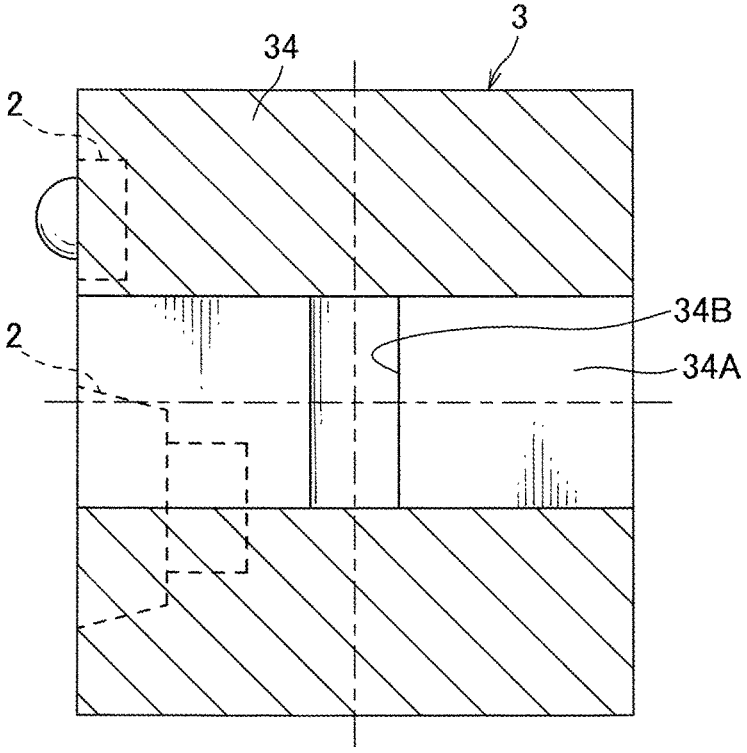
FIG. 4 is a cross section taken at the line II-II in FIG. 2.

Further, in the side wall 34, as shown in FIG. 3 to FIG. 5, at the area encompassing its central portion, there is provided a first opening 34B making the interior space of the cabinet 3 communicated with the inlet of the first duct 34A. Further, the first opening 34B is, as shown in FIG. 4, formed in a rectangular shape elongated in the vertical direction. The first opening 34B has the same height as the first duct 34A in the vertical direction of the first duct 34A.

By providing the above-described first duct 34A and the first opening 34B, the low tones radiated from the rearward side with respect to the speaker device 2 enter into the first duct 34A from the first opening 34B as shown in FIG. 5, and are radiated towards the outside of the cabinet 3 from the openings provided in the front wall 31 and the rear wall 32 through the first duct 34A.

Next, the standing wave generated in the interior space of the above-described cabinet 3 will be described with reference to FIG. 6. Typically, a phenomenon is occurred, that has been known as sympathetic vibration or resonance, by means of a formation of the two walls (ends) that are perpendicular to the traveling direction of the one-dimensional wave or the plane wave. In the portion interposed between the two ends, a wave having been reflected at the one end is reflected again at the other end. This repetition of the reflection causes a standing wave whose amplitude is drastically amplified.

Figure 6A:
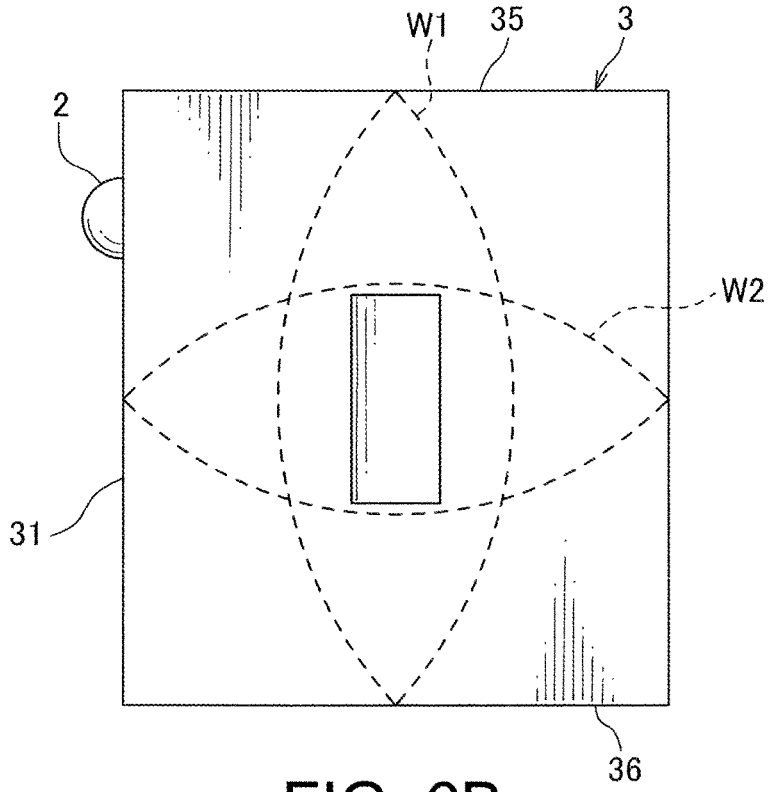
FIG. 6 is an explanatory view for explaining the standing wave formed in the speaker system as shown in FIG. 1.
Figure 6B:
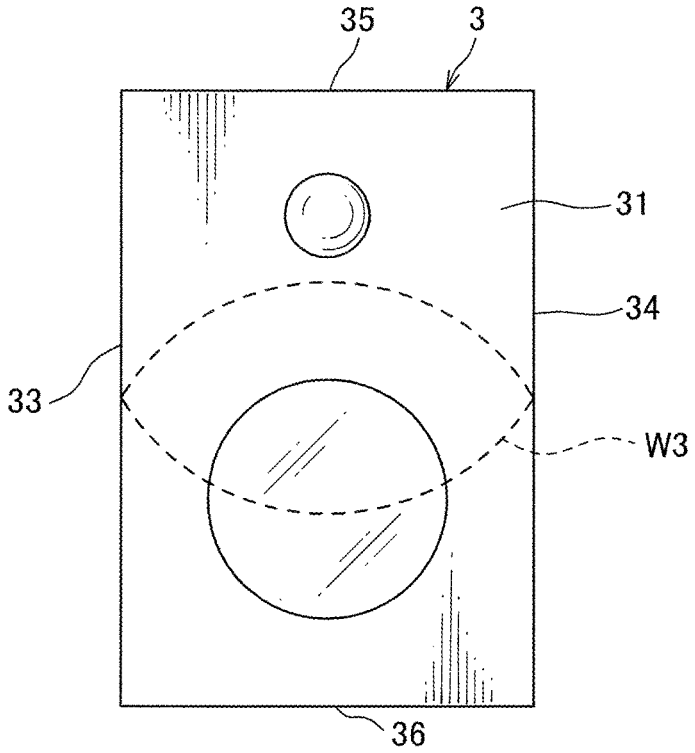

In the cabinet 3 having a rectangular parallelepiped shape as described above, three pairs of the front wall 31 and the rear wall 32, the side wall 33 and the side wall 34, and the side wall 35 and the side wall 36 oppose to one another. Then, standing waves W1 to W3 are respectively generated between the mutually opposing the front wall 31 and the rear wall 32, between the side wall 33 and the side wall 34, and between the side wall 35 and the side wall 36. As shown in FIG. 6A, the standing wave W1 is generated such that the side wall 35 and the side wall 36 as fixed ends are to serve as nodes, and the central portion between the side wall 35 and the side wall 36 is to serve as an arc-shaped portion. Further, the standing wave W2 is generated such that the front wall 31 and the rear wall 32 as fixed ends are to serve as nodes and the central portion between the front wall 31 and the rear wall 32 is to serve as an arc-shaped portion. Furthermore, as shown in FIG. 6B, a standing wave W3 is generated such that the side wall 33 and the side wall 34 as fixed ends are to serve as nodes and the central portion between the side wall 33 and the side wall 34 is to serve as an arc-shaped portion.

In this example, the distance between the side walls 35 and 36 becomes the longest, the distance between the front wall 31 and the rear wall 32 becomes the next longest, and the distance between the side walls 33 and 34 is the shortest. Thus, it should be noted that with regard to the frequency of the standing waves W1 to W3, the standing wave W1 has the lowest one, the standing wave W2 has the next lowest one, and the standing wave W3 has the highest one.

Figure 7:
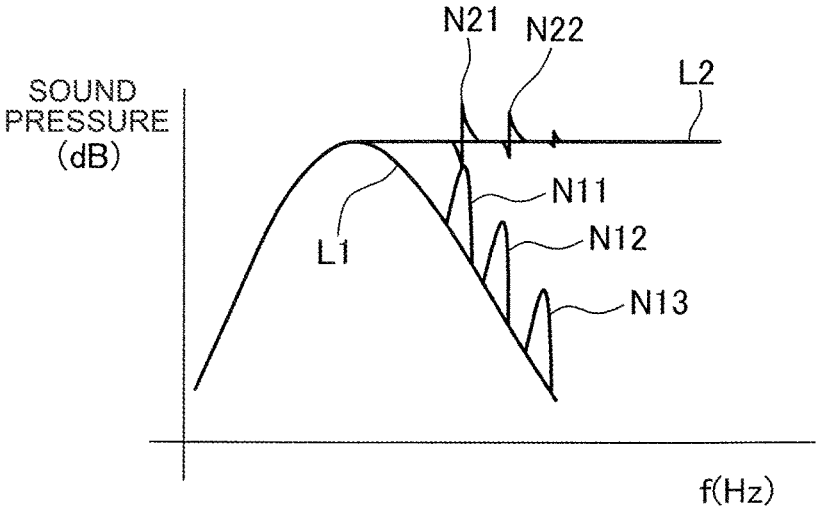
FIG. 7 is a graph showing the frequency characteristic of the speaker system and the first duct provided in this speaker system as shown in FIG. 1.

Next, the influences of the standing waves W1 to W2 on the frequency characteristic of the speaker system 1 are described with reference to FIG. 7. In the drawing, the mark L1 indicates the frequency characteristic of the first duct 34A, the mark L2 indicates the frequency characteristic of the overall speaker system 1. As aforementioned, the first duct 34A is a duct from which low tones are derived. Hence, the frequency characteristic of the first duct 34A is observed as having a high sound pressure within the low frequency wave range, whereas is observed as having a low sound pressure within the high frequency wave range.

When the standing waves W1 to W3 as described above, are generated, the frequency characteristic of the first duct 34A at the frequency of each of the standing waves W1 to W3 is made disturbed, so as to exert its influence on the frequency characteristic of the speaker system 1. That is, if it were not for the standing waves W1 to W3, the frequency characteristic of the first duct 34A shall be, as indicated by the mark L1 in the drawing, such that the sound pressure is gradually reduced as reaching high frequency. Actually nonetheless, the frequency characteristic is disturbed due to the influence of the standing waves W1 to W3 as indicated by the marks N11 to N13. In the meantime, the marks N11, N12, and N13 respectively show the turbulence in the frequency characteristic of the first duct 34A due to the influence of the standing waves W1, W2, and W3. In particular, at the low frequency of the standing waves W1 and W2, the sound pressure of the first duct 34A is stayed high therewith, the speaker system 1 is prone to be influenced thereby in its frequency characteristic. Conversely, at the high frequency of the standing wave W3, since the sound pressure of the first duct 34A has been scarcely observed, the influence on the frequency characteristic of the speaker system 1 has been scarcely observed as well. Accordingly, if it were not for the standing waves W1 to W3, the frequency characteristic of the speaker system 1 shows, as indicated by the mark L2 in the figure, a substantially plain characteristic in the high-frequency range. However, being influenced by the standing waves W1 and W2, a turbulence is caused in the frequency characteristic as indicated by the marks N21 and N22. In the meantime, the marks N21 and N22 respectively show a turbulence in the frequency characteristic of the speaker system 1 due to the influence of the standing waves W1 and W2. Nonetheless, a turbulence in the frequency characteristic due to the influence of the standing wave W3 has been scarcely observed.

In this example, the first opening 34B is provided at the area encompassing the central portion of the side wall 34 as the one side wall in the side walls 33 and 34 having a short mutual distance therebetween. Hence, as shown in FIG. 6A, the first opening 34B can be provided at the portions corresponding to the arc-shaped portions of the low standing waves W1 and W2, which are likely to exert influence on the frequency characteristic of the speaker system 1, that are the portions at which the sound pressures of the standing wave W1 and W2 take the minimum value, thereby becoming less susceptible to the influence of the standing waves W1 to W3. Further, as shown in FIG. 6A, although the first opening 34B is provided at the portion corresponding to the node of the standing wave W3, that is the portion at which the sound pressure of the standing wave W3 takes the maximum value, it should be noted that the original influence by the standing wave W3 having high frequency can be neglected as aforementioned.

Further, according to the above-mentioned first example, the first duct 34A is extended along the side wall 34 through which the first opening 34B is provided, and the outlet of the first duct 34A is provided at a further forward position (i.e., sound-wave-radiation direction side) than the inlet of the first duct 34A with respect to the speaker device 2. Thereby, the sound having passed through the first duct 34A is allowed to be radiated forwardly in the sound-wave-radiation direction.

Further, according to the above-mentioned first example, the outlet of the first duct 34A is provided at a further backward position (i.e., reverse side, reverse to the sound-wave-radiation direction side) than the inlet of the first duct 34A with respect to the speaker device 2. Thereby, the sound having passed through the first duct 34A is allowed to be radiated backwardly in the sound-wave-radiation direction.

Figure 9A:
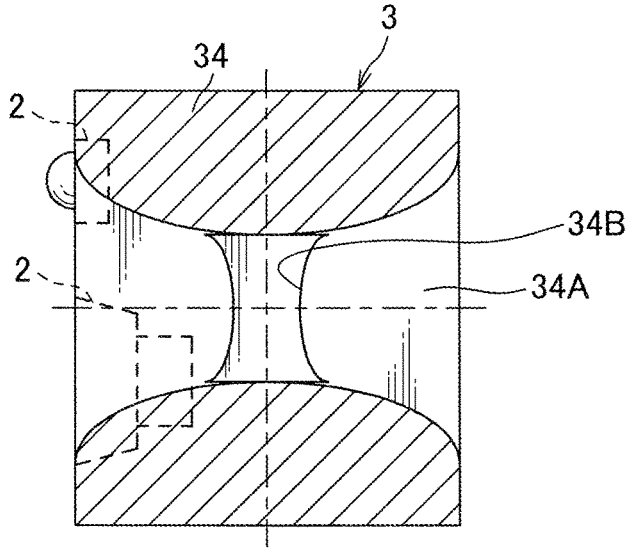
FIG. 9 is a view of a cross section taken at the line II-II in FIG. 2 of another example.
Figure 9B:
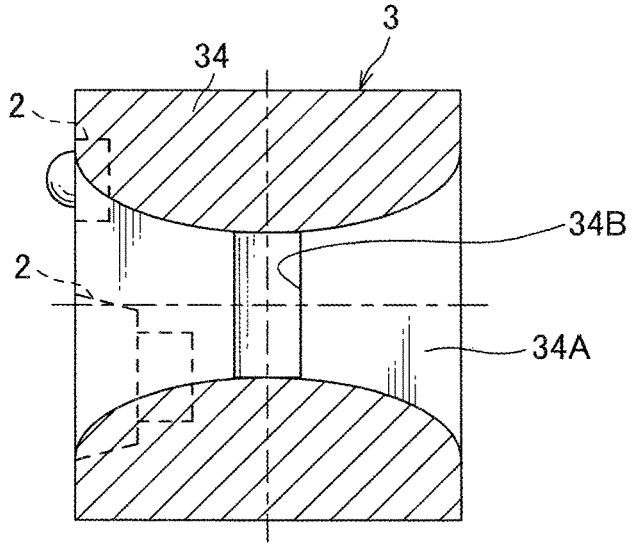
Figure 9C:
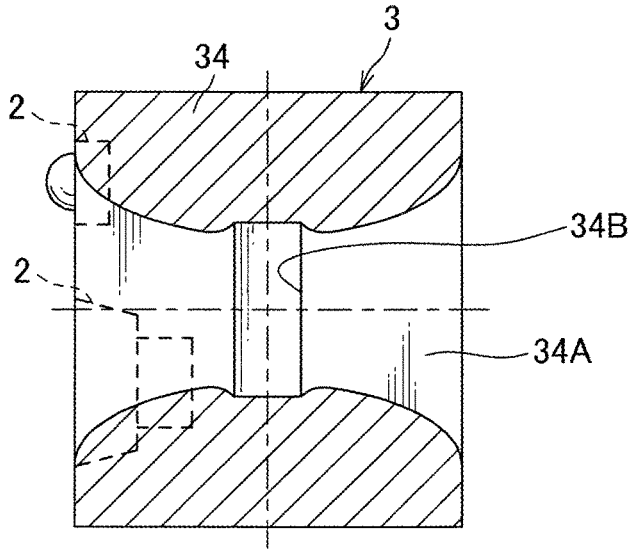

In the meantime, although in the first example, the first duct 34A has an identical square measure at every position between the inlet and the outlet, and the first opening 34B is formed in a rectangular shape, the present invention is not limited thereto. For example, as shown in FIGS. 9A and 9B, the first opening 34B may be provided so as to have larger square measures towards the outlet from the inlet of the first duct 34A. Thereby, the sound wave can be radiated without causing unnecessary turbulent air or the like within the first duct 34A. Further, as shown in FIG. 9C, the vicinity area of the inlet of the first duct 34A may be designed such that the square measures thereof become smaller towards the outlet, and afterward, its square measures become larger towards the outlet.

Further, as shown in the figure, the first duct 34A has wider widthwise sizes (i.e., widthwise size in a direction parallel to the side wall 34) in the vertical direction towards the outlet from the inlet, and has a constant widthwise size (i.e., direction intersecting with the side wall 34) in the crosswise direction towards the outlet from the inlet. Thereby, the square measures of the first duct 34A towards the outlet from the inlet are allowed to be larger while the widthwise sizes in the crosswise direction of the speaker system 1 is maintained in constant.

Figure 8:
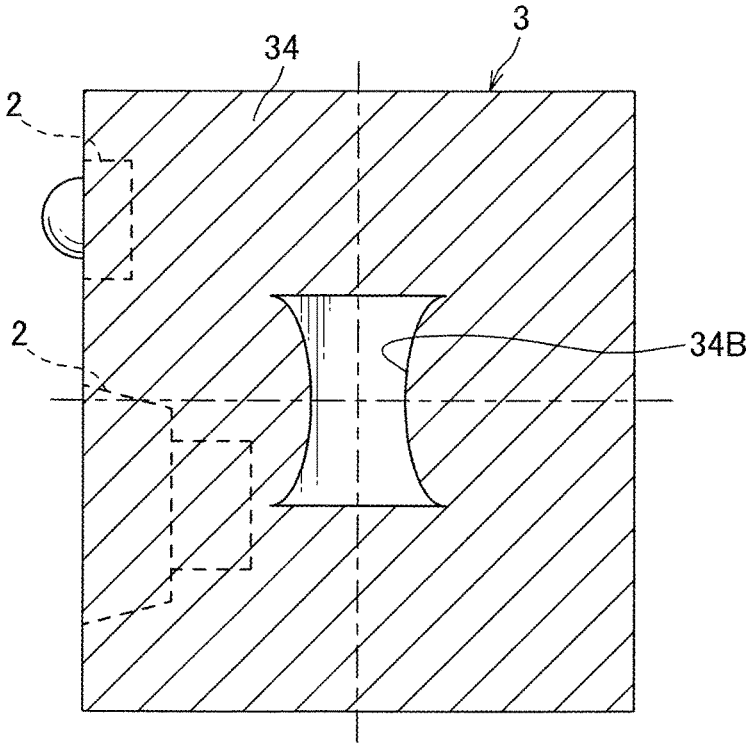
FIG. 8 is a view of a cross section taken at the line I-I in FIG. 2 of another example.

Further, the first opening 34B may be formed, as shown in FIG. 8 and FIG. 9A, such that the peripheral portions opposing in the front to rear direction (i.e., direction extending from the inlet towards the outlet of the first duct 34A) to each other are located closer to each other as approaching to the central portion. Thereby, the sound wave is allowed to be radiated without causing unnecessary turbulent air or the like within the first duct 34A. Of course, as shown in FIGS. 9B and 9C, the first duct 34A may be formed in a horns-like shape, and the first opening 34B may be formed in a rectangular shape as in the first example.

Second Example

Figure 10:
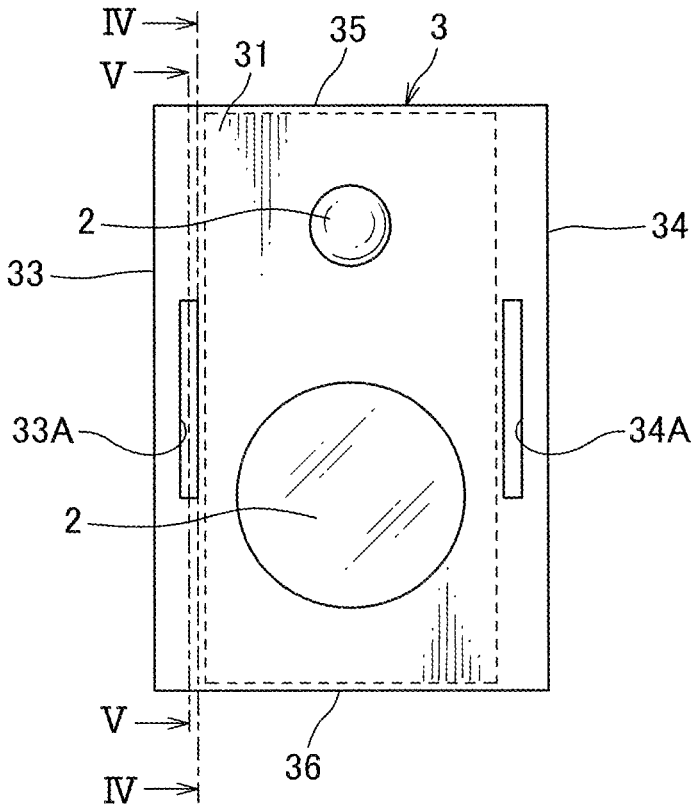
FIG. 10 is a front view of the speaker system in the second example of the present invention.

Next, the speaker system 1 in the second example is described with reference to FIG. 10 to FIG. 12. The difference between the first example and the second example lies in that a second duct 33A and a second opening 33B are provided at the side wall 33 that is the other one in the pair of the side walls 33 and 34 having smaller mutual distance therebetween.

The second duct 33A, similarly to the first duct 34A, radiates low tones generated from the rearward side in the front to rear direction through the interior space of the cabinet 3 towards the outside of the cabinet 3.

The second duct 33A is also extended in the front to rear direction along the side wall 33, and its outlets are respectively provided closer to the forward side and the rearward side than the inlet of the second duct 33A. That is, at the front wall 31 and the rear wall 32, openings serving as the outlets of the second duct 33A are respectively provided. The cross section of the above-described second duct 33A is formed in a rectangular shape elongated in the vertical direction, and is also provided so as to have a constant square measure towards the outlet from the inlet.

Figure 11:
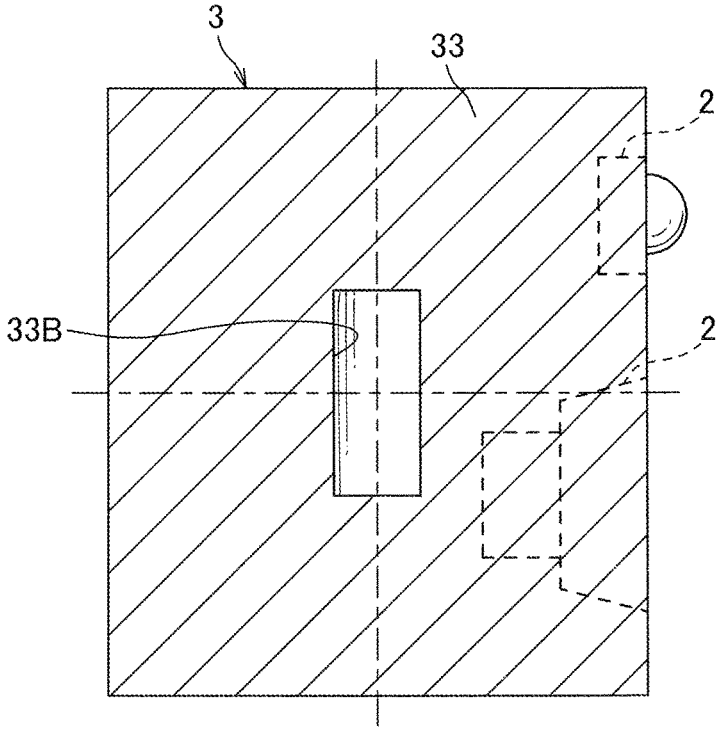
FIG. 11 is a view of the cross section taken at the line IV-IV in FIG. 10.
Figure 12:
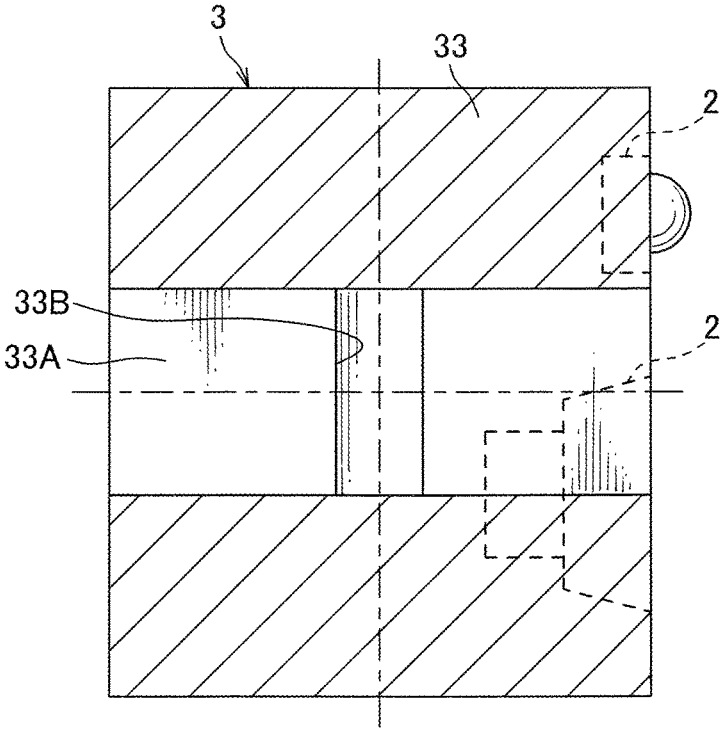
FIG. 12 is a view of the cross section taken at the line V-V in FIG. 10.

Further, in the side wall 33, as shown in FIG. 11 and FIG. 12, the second opening 33B making the interior space of the cabinet 3 communicated with the inlet of the second opening 33A at the area encompassing its central portion. Further, the second opening 33B is provided, as shown in FIG. 11, in a rectangular shape elongated in the vertical direction. The second opening 33B has the same height as the second duct 33A in the vertical direction.

Also in this case, by providing the second opening 33B at the area encompassing the central portion of the side wall 33, the portions corresponding to the arc-shaped portions of the standing waves W1 and W2 having low frequency are lead to the second duct 33A, the influence of the standing waves W1 to W3 can be reduced in a similar manner.

Further, also with regard to the second duct 33A, as shown in FIG. 8 and FIG. 9, may be designed so as to have larger square measures from the inlet towards the outlet. Further, the second duct 33A may be provided so as to have larger widthwise sizes towards the outlet from the inlet in the vertical direction, and so as to have a constant widthwise size towards the outlet from the inlet. Further, the second opening 33B may be designed, in a similar manner to the first opening 34B as shown in FIG. 8 and FIG. 9, such that in the second opening 33B, the peripheral portions opposing in the direction extending from the inlet towards the outlet are closer as approaching to the central portion.

In the meantime, although in the first and second examples as described above, the outlets of the first duct 34A and the second duct 33A are respectively provided in the two areas of the forward side and the rearward side, the present invention is not necessarily limited thereto. The outlet of the first duct 34A and the second duct 33A may be provided at either one of the forward side or the rearward side.

In the above-described first and second example, the cabinet 3 is formed in a rectangular parallelepiped shape, the present invention is not necessarily limited thereto. The cabinet 3 only have to be formed in any substantially rectangular parallelepiped shapes, for example, may be formed in a shape in which portion(s) of the corners of the rectangular parallelepiped shape has been lost.

Further, although in the example as described above, the cabinet 3 is provided with two speaker devices 2, the present invention is not necessarily limited thereto. Only one speaker device 2 may also be affixed to the cabinet 3, or three or more than three speaker devices 2 may also be affixed to the cabinet 3.

Further, the example described above merely exemplifies a representative aspect of the present invention. The present invention is not necessarily limited to the embodiment. That is, the present invention may be modified to be implemented in various forms without departing from the gist of the present invention.

REFERENCE SIGNS LIST

1 speaker system
2 speaker device
3 cabinet
31 front wall (speaker-fixation wall)
32 rear wall (opposing walls)
33 to 36 side wall
33A second duct
33B second opening
34A first duct
34B first opening

The invention claimed is:

1. A speaker system comprising:

a speaker device; and a cabinet including a speaker-fixation wall to which the speaker device is to be affixed, an opposing wall opposing to the speaker-fixation wall, and two pairs of side walls opposing to each other that are provided between the speaker-fixation wall and the opposing wall, wherein a first duct communicating with an interior space of the cabinet is provided at the side wall of the cabinet, wherein a first opening that makes the interior space of the cabinet communicated with an inlet of the first duct is provided at an area encompassing a central portion of one side wall in an one pair of side walls that has a shorter mutual distance therebetween in the two pairs of side walls, wherein a second duct communicating with the interior space of the cabinet is provided at the side wall of the cabinet, and wherein a second opening that makes the interior space of the cabinet communicated with an inlet of the second duct is provided at an area encompassing a central portion of an other side wall in one pair of side walls that has a shorter mutual distance therebetween in the two pairs of side walls.

2. The speaker system as defined in claim 1, wherein the first duct is extended along the side wall through which the first opening is provided, and wherein an outlet of the first duct is provided at a further forward position in a sound-wave-radiation direction than an inlet thereof with respect to the speaker device.

3. The speaker system as defined in claim 1, wherein the first duct is extended along the side wall through which the first opening is provided, and wherein an outlet of the first duct is provided at a further backward position in a sound-wave-radiation direction than an inlet thereof with respect to the speaker device.

4. The speaker system as defined in claim 1, wherein at least one of the first duct and the second duct is extended along the first opening communicated with its inlet or the side wall through which the second opening is provided, and wherein an outlet of at least one of the first duct and the second duct is provided at a further forward position in a sound-wave-radiation direction than an inlet thereof with respect to the speaker device.

5. The speaker system as defined in claim 1, wherein at least one of the first duct and the second duct is extended along the first opening communicated with its inlet or the side wall through which the second opening is provided, and wherein an outlet of at least one of the first duct and the second duct is provided at a further backward position in a sound-wave-radiation direction than an inlet thereof with respect to the speaker device.

6. The speaker system as defined in claim 1, wherein the first duct is provided so as to have larger square measures towards the outlet from the inlet.

7. The speaker system as defined in claim 6, wherein the first duct has longer widthwise sizes in a direction parallel to the side wall through which the first opening is provided, and has a substantially constant widthwise size in a direction intersecting with the side wall through which the first opening is provided.

8. The speaker system as defined in claim 1, wherein at least one of the first duct and the second duct is provided so as to have larger square measures towards the outlet from the inlet.

9. The speaker system as defined in claim 8, wherein at least one of the first duct and the second duct has longer widthwise size in a direction parallel to the side wall through which the first opening or the second opening is provided, towards the outlet from the inlet, and has a substantially constant widthwise size in a direction intersecting with the side wall through which the first opening or the second opening is provided.

10. The speaker system as defined in claim 1, wherein peripheral portions opposing to each other in a direction extending from the inlet to the outlet of the first duct in the first opening are provided so as to be closer as approaching to the central portion.

11. The speaker system as defined in claim 1, wherein peripheral portions opposing to each other in a direction extending from the inlet to the outlet of the first duct or the second duct in at least one of the first opening or the second opening, are provided so as to be closer as approaching to the central portion.

* * * * *